US007195850B2

(12) United States Patent
Srinivasan

(10) Patent No.: US 7,195,850 B2
(45) Date of Patent: Mar. 27, 2007

(54) PHOTOCONDUCTOR WITH LIGHT FATIGUE ADDITIVES

(75) Inventor: Kasturi Rangan Srinivasan, Longmont, CO (US)

(73) Assignee: Lexmark International, Inc., Lexington, KY (US)

( * ) Notice: Subject to any disclaimer, the term of this patent is extended or adjusted under 35 U.S.C. 154(b) by 395 days.

(21) Appl. No.: 10/802,967

(22) Filed: Mar. 17, 2004

(65) Prior Publication Data

US 2005/0208401 A1 Sep. 22, 2005

(51) Int. Cl.
*G03G 5/06* (2006.01)

(52) U.S. Cl. ..... 430/58.25; 430/58.4; 430/72

(58) Field of Classification Search ..... 430/58.25, 430/58.4, 58.45, 59.5, 72, 83, 96
See application file for complete search history.

(56) References Cited

U.S. PATENT DOCUMENTS 4,106,934 A * 8/1978 Turnblom ..... 430/71
4,362,798 A 12/1982 Anderson et al.
5,545,499 A 8/1996 Balthis et al.
5,700,614 A * 12/1997 Kawahara et al. ..... 430/58.35
5,994,014 A 11/1999 Hinch et al.
6,544,702 B1 * 4/2003 Haggquist et al. ..... 430/58.4

FOREIGN PATENT DOCUMENTS

JP 64-040835 2/1989
JP 06-161123 6/1994

OTHER PUBLICATIONS

*Colour Index*, (3rd revision) vol. 7 The Society of Dyers & Colourists (1982) pp. 7234-7235.*
ACS File Registry No. 92091-43-5 Copywrite 2001.*

* cited by examiner

*Primary Examiner*—John L Goodrow
(74) *Attorney, Agent, or Firm*—John A. Brady

(57) ABSTRACT

A photoconductor having a charge generation layer and a charge transport layer, the charge transport layer having hydrazone or aryl amine charge transport molecules and also having as room light protective additives acetosol yellow 5GLS and tetraphenylcyclopentadienone or 9-fluorenone. Preferably the amount of the acetosol yellow is 2 to 4 percent by weight of the weight of the charge transfer layer and the ratio of weight between the acetosol yellow and the dienone or fluorenone is in the range of 1:1 to 1:3.

17 Claims, No Drawings

PHOTOCONDUCTOR WITH LIGHT FATIGUE ADDITIVES

TECHNICAL FIELD

This invention is directed to charge transport layers in a photoconductor, which comprises a hydrazone or aryl amine transport molecule and additives to reduce room light fatigue.

BACKGROUND OF THE INVENTION

An electrophotographic photoreceptor essentially comprises a charge generation layer (CGL) and charge transport layer (CTL) coated on a suitable substrate. The substrate may be an aluminized MYLAR polyester or an anodized aluminum drum (termed a PC drum). An aluminum drum can be coated with a suitable sub-layer and/or a barrier layer, derived by dispersing metal oxides in a polymer binder.

The charge generation layer comprises pigments or dyes selected from phthalocyanines, squaraines, azo compounds, perylenes etc. The pigment or dye may be dispersed or dissolved in a suitable solvent, with or without a polymer binder. The use of polymer binder helps improve the dispersion stability and improve the adhesion of the CGL to the core or other substrate. However, depending on the type of polymer binder being used, the sensitivity of the photoreceptor may be affected.

As printers are expected to perform at speeds of 30–50 pages-per-minute, it becomes imperative that the photoconductor charge and discharge at very short time intervals. The time frames required for 35 ppm, for example could relate to an expose-to-develop time in the order of 40–80 ms. Hence, there is a growing need to identify systems that improve the electrophotographic properties without compromising on other properties such as adhesion, fatigue, and the like.

Also, with a move towards faster systems, the drive towards lower cost becomes more demanding. One area where cost can be lowered is by using a cartridge that does not have a shutter for the photoconductor drum. Optionally, a separation of function can be envisioned wherein the photoconductor may be a part of the printer and not the toner cartridge. In this case, the photoconductor may be highly susceptible to exposure to room light, when the toner cartridge is replaced. Most photoconductor formulations are sensitive to the effect of room light (eg. fluorescent light).

As shown in this invention, the exposure to room light (fluorescent light) can cause severe fatigue (electrical and the related print) in the PC drum. This results in a print defect pattern. This invention addresses possible methods of mitigating any fatigue or deterioration in electrophotographic properties brought about by exposure to room light.

The acetosol yellow 5GLS of this invention is also known by the trademark SAVINYL YELLOW and as Colour Index Solvent Yellow 138. It is an ingredient of a more-than-twenty-year-old patent, specifically U.S. Pat. No. 4,362,798 to Anderson et al.

The foregoing U.S. Pat. No. 4,362,798 and U.S. Pat. No. 6,544,702 to Haggquist et al. disclose the use of acetosol yellow 5GLS as a room light fatigue mitigant, in a hydrazone transport. U.S. Pat. No. 5,545,499 (Balthis et al., Lexmark International, Inc.) discloses hydrazone charge transport.

JP 06-161123 A, published Jun. 7, 1994, (Mita Ind Co.) claims the use of cyclopentadienone type compound in the sensitive layer.

JP 64-040835 A, published Feb. 13, 1989 (Toshiba Corp.) describes the use of a tetraphenylcyclopentadienone in a N-ethylcarbazole hydrazone transport layer coated on a charge generating layer comprising of a tau-type phthalocyanine and polyvinylbutyral. In addition, a suitably substituted cyclohexenedienone is also disclosed.

DISCLOSURE OF THE INVENTION

This invention comprises a photoconductor member having a charge generation layer, a charge transport layer having a hydrazone or amine charge transport molecules and having as room-light fatigue protective additives acetosol yellow 5GLS and an electron acceptor compound selected from tetraphenylcyclopentadienone or 9-fluorenenone.

The total amount of room light fatigue additive mixture is at least 1% by weight, and no more than 5% by weight of the total weight of the charge transport layer. Preferably amounts are 2% to 4% by weight of the total weight of the charge transport layer.

When the charge transport molecule is a hydrazone, at least 1% by weight of acetosol yellow 5GLS of the total weight of the charge transport layer is mixed with the tetraphenylcyclopentadienone or fluorenone in a weight ratio of 1:1 to 3:1.

When the charge transport molecule is arylamine, at least 1% by weight of acetosol yellow 5GLS of the total weight of the charge transport layer is mixed with the tetraphenylcyclopentadienone or flourenone also in a weight ratio of 1:1 to 3:1.

DESCRIPTION OF THE INVENTION

The need for higher sensitivity photoconductors geared towards laser printers that are capable of outputs exceeding 30–50 ppm (pages-per-minute) relates to higher efficiencies for the charge generation/charge transport molecules. Along with the higher sensitivity, the stability of the photoconductor drums towards exposure to fluorescent light or room light is critical. In most cases, the charge transport layer is adversely affected when exposed to room light.

The electrophotographic properties of the photoconductor deteriorate with increased exposure to light, which in turn causes a degradation in print-quality. In some cases the degradation is so severe that the photoconductor does not discharge at all. The degradation in the photoconductor performance and print-quality may be overcome by suitably selecting charge generation and/or charge transport materials that are unaffected by room light, or additives that can increase the resistance to the effects of the room light. This invention pertains to the use of additive blends of acetosol yellow 5GLS (AY) and an electron acceptor such as tetraphenylcyclopentadienone (TPCPDEO) or 9-fluorenone in the charge transport layer. The mixture of additives helps increase the resistance of the photoconductor drum to room light exposure, and also in the recovery of the drums that have been affected.

In order to evaluate the effects of the additives on the effect of room light several charge transport molecules were evaluated. The CTM's were either arylamines such as N,N'diphenyl-N,N'-ditolyl-4,4'-biphenyldiamine (TPD) or tri(p-tolylamine) (TTA) or hydrazones such as N,N-diethylaminobenzaldehyde-1,1-diphenylhydrazone (DEH).

Materials Used:

TPD:N,N'diphenyl-N,N'-ditolyl-4,4'-biphenyldiamine

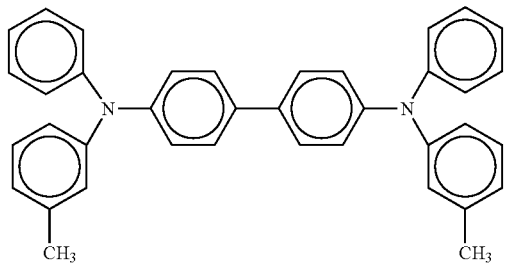

DEH: N,N-diethylaminobenzaldehyde-1,1-diphenylhydrazone

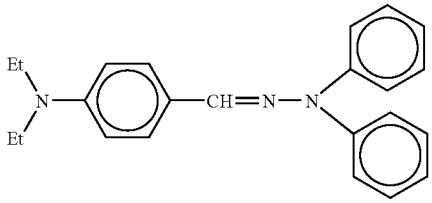

Tetraphenylcyclopentadienone (TPCPDEO):

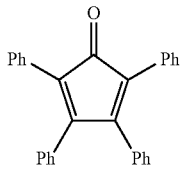

9-Fluorenone:

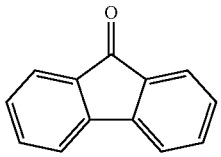

Test Method

In a typical case, two photoconductor drums containing the same formulation were used for analysis. Initial photo induced decay (PID) was measured by charging the drum using a charge roll, and measuring the discharge voltage as a function of laser energy, using a 780 nm laser. The PID was obtained as a plot of negative photoconductor voltage (−V) against laser energy (μJ/cm$^2$). A duplicate drum was exposed to fluorescent light for about 20 minutes to about 60 minutes, and the PID measured immediately.

In some cases, the drums were electrically cycled by repeated charge/discharge, for 1000 cycles (1 k), and the PID measured, followed by the measurement of the dark decay. Dark decay corresponds to the charge lost as a function of time, and is represented as V/sec. In order to evaluate the extent of recovery from the room light exposure, the drums were stored in a black plastic bag, and a PID curve was obtained after the required recovery time frame. The recovery of the photoconductor drum was then compared to the initial charge/discharge voltages, and the difference corresponds to the fatigue induced in the photoconductor drum due to room light.

Positive fatigue corresponds to photoconductor drums that discharge at lower voltages either on exposure to room light or on cycling (repeated charge/discharge cycles) the drums, i.e. if a drum discharges to −200V, and discharges to −150V either on cycling or on exposure to room light, the drum is exhibiting positive fatigue of +50V. In this case, if the drum were to be used in printing a page, the prints corresponding to the lower discharging system would be darker than the initial prints. Similarly, negative fatigue corresponds to a drum exhibiting a discharge voltage that is higher than the initial. For example, if a drum on exposure to room light discharges at −200V instead of its −150V initial discharge, the drum exhibits −50V (or a negative fatigue of 50V). Positive and negative fatigue terminology is applicable to the change in dark decay for the drum for cycling or exposure to room light.

Hydrazone Tranports

Hydrazone transports such as DEH are prone to exhibit negative fatigue (in the absence of room light fatigue mitigant) on exposure to room light. On exposing the photoconductor drums containing a hydrazone transport material to fluorescent light, the discharge voltage for the drum increases. If the drum was used in a laser printer, the prints would appear to be lighter owing to the higher discharge voltage. In some cases, on electrically cycling the drums following exposure to room light, the drum does not discharge, and hence cannot be used to print. Hence it is critical to suitably protect charge transport layers from the effects of fluorescent light.

As a first procedure, acetosol yellow 5GLS was used as an additive in the charge transport layer. The use of acetosol yellow 5GLS is known in prior art. It is a common ingredient in a DEH formulation, and it helps improve the room light fatigue resistance. In a similar manner, the use of tetraphenylcyclopentadienone (TPCPDEO) as an electron transport material is known. Formulations of these materials were prepared, either as pure materials or as additives, in a DEH/polycarbonate transport formulation (Table 1). The charge generation layer was based on a 45/55 mixture of type IV oxotitanium phthalocyanine (TiOpc) in a polyvinylbutyral matrix. The photo induced decay (PID) was measured at an expose-to-develop time of 76 ms. Results from this experiment are presented in Table 2.

TABLE 1

Formulations corresponding to acetosol yellow 5GLS (AY) and TPCPDEO

| Materials | Transport 1 (Control) | Transport 2 (Acetosol Yellow) | Transport 3 (TPCPDEO) | Transport 4 (SY/TPCPDEO) |
|---|---|---|---|---|
| MAKROLON-5208 | 12 g | 12 g | 12 g | 12 g |
| DEH | 8 g | 8 g | 8 g | 8 g |
| Surfactant (DC-200) | 3 drops | 3 drops | 3 drops | 3 drops |
| THF | 75 g | 75 g | 75 g | 75 g |
| 1,4-Dioxane | 25 g | 25 g | 25 g | 25 g |
| Acetosol Yellow 5GLS | 0 g | 0.3 g | 0 g | 0.15 g |
| TPCPDEO | 0 g | 0 g | 0.3 g | 0.15 g |

TABLE 2

Electrical characteristics at 0k and 1k for DEH/MAKROLON-5208/drums

| Transport (1.5% Additive) | ct. wt. (mg/in2) | 0.0 μJ/cm$^2$ V(0k/1k) | 0.2 μJ/cm$^2$ V(0k/1k) | 0.4 μJ/cm$^2$ V(0k/1k) | 0.8 μJ/cm$^2$ V(0k/1k) |
|---|---|---|---|---|---|
| Transport 1 (Control) | 10.7 | −846/−841 | −401/387 | −169/−149 | −100/−95 |
| Transport 2 (AY) | 11.94 | −841/−858 | −389/−394 | −191/−182 | −156/−151 |
| Transport 3 (TPCPDEO) | 11.21 | −849/−835 | −291/−301 | −159/−147 | −129/−122 |
| Transport 4 (AY:TPCPDEO 1/1) | 11.23 | −842/−822 | −382/−381 | −186/−177 | −143/−140 |

TABLE 3

| Electrical characteristics before and following a 20 min. exposure to room light | | | | | |
|---|---|---|---|---|---|
| Transport (1.5% Additive) | ct. wt. (mg/in2) | 0.0 μJ/cm$^2$ V(init/RLE) | 0.2 μJ/cm$^2$ V(init/RLE) | 0.4 μJ/cm$^2$ V(init/RLE) | 0.8 μJ/cm$^2$ V(init/RLE) |
| Transport 1 (Control) | 10.57 | −846/−853 | −401/−554 | −169/−554 | −100/−525 |
| Transport 2 (AY) | 11.46 | −841/−852 | −389/−386 | −191/−168 | −156/−129 |
| Transport 3 (TPCPDEO) | 11.16 | −849/−856 | −291/−409 | −159/−268 | −129/−212 |
| Transport 4 (AY:TPCPDEO 1/1) | 11.79 | −842/−838 | −382/−344 | −186/−185 | −143/−159 |

(init: electrostatics prior to exposure;
RLE: electrostatics following exposure to room light)

TABLE 4

| Electrical characteristics at 0k and 1k, following a 20 min. exposure to room light | | | | | |
|---|---|---|---|---|---|
| Transport (1.5% Additive) | ct. wt. (mg/in2) | 0.0 μJ/cm$^2$ V(0k/1k) | 0.2 μJ/cm$^2$ V(0k/1k) | 0.4 μJ/cm$^2$ V(0k/1k) | 0.8 μJ/cm$^2$ V(0k/1k) |
| Transport 1 (Control) | 10.57 | −853/−860 | −554/−780 | −554/−770 | −525/−761 |
| Transport 2 (AY) | 11.46 | −852/−846 | −386/−391 | −168/−182 | −129/−154 |
| Transport 3 (TPCPDEO) | 11.16 | −849/−856 | −409/−452 | −214/−268 | −156/−212 |
| Transport 4 (AY:TPCPDEO 1/1) | 11.79 | −847/−838 | −344/−364 | −153/−185 | −124/−159 |

The results from Table 2, indicate that the addition of the additives, acetosol yellow 5GLS and TPCPDEO tend to lower the dark decay and reduce the 1 k electrical cycling fatigue. The best results are obtained when the two materials are used together, rather than individually (Table 2).

On exposing the drums to room light for 20 minutes, the control drum (DEH with no additive) showed severe negative fatigue, to the extent that it exhibited no photoconducting property (Table 3). However, the additives were relatively more stable. TPCPDEO, caused the drum to fatigue negative. Acetosol yellow 5GLS results in slight positive fatigue.

In contrast, the mixture of additives caused the smallest change in the drum electrical characteristics with respect to room light exposure. Also, this system exhibited the lowest dark decay and its change when the drum was subjected to 1000 charge-discharge cycles (e.g. Table 4).

The effect of the additives on mitigating the room light fatigue occurring from a long-term exposure was explored further. Higher concentrations of the additives were used. The control drum was based on a 2% acetosol yellow 5GLS concentration, and compared to 2% AY/0.5% TPCPDEO or 9-fluorenone blend (Table 5). The charge generation layer comprised of 45% TiOpc (type IV/type I2/1 blend) and 55% (polyvinylbutyral/epoxy resin 1/1) binder blend. Electrostatic characteristics were measured with an expose-to-develop time of 174 ms (Table 6).

TABLE 5

| Formulations corresponding to acetosol yellow 5GLS and TPCPDEO or 9-Fluorenone | | | | |
|---|---|---|---|---|
| Materials | Transport 5 (AY) | Transport 6 (9-Fluorenone) | Transport 7 (SY:Fluorenone 3/1) | Transport 8 (SY:TPCPDEO 3/1) |
| MAKROLON-5208 | 42 g | 42 g | 42 g | 42 g |
| DEH | 28 g | 28 g | 28 g | 28 g |
| Surfactant (DC-200) | 6 drops | 6 drops | 6 drops | 6 drops |
| THF | 210 g | 210 g | 210 g | 210 g |
| 1,4-Dioxane | 70 g | 70 g | 70 g | 70 g |
| Acetosol Yellow 5GLS | 1.40 g | 0 g | 1.40 g | 1.40 g |
| 9-Fluorene | 0 g | 0.77 g | 0.35 g | 0 g |
| TPCPDEO | 0 g | 0 g | 0 g | 0.35 g |

TABLE 6

| Electrical characteristics before and following a 60 min. exposure to room light | | | | | | |
|---|---|---|---|---|---|---|
| Additive | ct. wt. (mg/in2) | 0.0 μJ/cm$^2$ V(init/RLE) | 0.2 μJ/cm$^2$ V(init/RLE) | 0.4 μJ/cm$^2$ V(init/RLE) | 1 μJ/cm$^2$ V(init/RLE) | Dark decay (init/RLE) |
| Transport 5 (Acetosol Yellow 5GLS) | 16.3–16.7 | −746/−742 | −382/−373 | −211/−191 | −159/−135 | 20/32 |
| Transport 6 (9-Fluorenone) | 14.5/14.2 | −743/−741 | −359/−491 | −242/−433 | −64/−380 | 31/19 |
| Transport 7 (AY:Fluorenone 3/1) | 17.5/17.2 | −739/−754 | −377/−374 | −208/−202 | −158/−158 | 20/30 |
| Transport 8 (AY:TPCPDEO 3/1) | 16.8–16.7 | −734/−741 | −376/−365 | −207/−204 | −157/−165 | 16/29 |

| Additive | ct. wt. (mg/in2) | 0.21 μJ/cm$^2$ V Fatigue | 0.33 μJ/cm$^2$ V Fatigue | 1 μJ/cm$^2$ V Fatigue | Dark decay Fatigue |
|---|---|---|---|---|---|
| Transport 5 (Acetosol Yellow 5GLS) | 16.3/16.7 | 9 | 20 | 24 | 12 |
| Transport 6 (9-Fluorenone) | 14.5/14.2 | −132 | −191 | −316 | −12 |
| Transport 7 (AY:Fluorenone 3/1) | 17.5/17.2 | 3 | 6 | 0 | 10 |
| Transport 8 (AY:TPCPDEO 3/1) | 16.8/16.7 | 11 | 3 | −8 | 13 |

As can be seen from Table 6, the control drum (2% acetosol yellow 5GLS) exhibited positive fatigue (lower discharge, more sensitive), whereas in the presence of either 0.5% fluorenone or TPCPDEO, the room light fatigue was mitigated, without compromising on initial electrostatic characteristics. It may also be noted that the use of fluorenone alone (in the absence of acetosol yellow 5GLS) does not offer any protection towards room light.

Benzidine Transports

The use of acetosol yellow 5GLS as a room light fatigue mitigant was evaluated in benzidine transports. Formulations were based on either the use of pure acetosol yellow 5GLS or as a blend with other electron-acceptors such as 9-fluorenone or TPCPDEO. Results from various experiments are presented in Table 7 below.

TPD/TOSPEARL Silicone Microspheres/MAKROLON-5208 Polycarbonate

Anodized drums were coated with a charge generation layer corresponding to 45% TiOpc/BX-55Z and a charge transport layer comprising of, by weight, 30% TPD/MAKROLON-5208 polycarbonate/2.3% TOSPEARL silicone microspheres charge transport layer, in the presence of the additives (acetosol yellow 5GLS and TPCPDEO) were evaluated for resistance to light fatigue. Table 7 describes the various formulations and the corresponding electrostatics for these drums, prior, after exposure to room light and following a 2 h recovery time are presented in Table 8.

TABLE 7

| Formulations for room light fatigue (RLF) additives in a TPD/PC_A and TOSPEARL silicone microspheres containing transports. | | | | |
|---|---|---|---|---|
| Materials | Transport 9 (Control) | Transport 10 (Acetosol Yellow 5GLS) | Transport 11 (TPCPDEO) | Transport 12 (AY:TPCPDEO 1/1) |
| MAKROLON-5208 | 15.75 g | 15.75 g | 15.75 g | 15.75 g |
| TPD | 6.75 g | 6.75 g | 6.75 g | 6.75 g |
| TOSPEARL-120 | 0.52 g | 0.52 g | 0.52 g | 0.52 g |
| Surfactant (DC-200) | 3 drops | 3 drops | 3 drops | 3 drops |
| THF | 67.5 g | 67.5 g | 67.5 g | 67.5 g |
| 1,4-Dioxane | 22.5 g | 22.5 g | 22.5 g | 22.5 g |
| Acetosol Yellow 5GLS | 0 g | 0.38 g | 0 g | 0.19 g |
| TPCPDEO | 0 g | 0 g | 0.38 g | 0.19 g |

TABLE 8

| Additive (1.5%) | Ct. wt. (mg/in2) | 0.0 μJ/cm² V(In/RLE/Rec) | 0.2 μJ/cm² V(In/RLE/Rec) | 0.4 μJ/cm² V(In/RLE/Rec) | 0.8 μJ/cm² V(In/RLE/Rec) | Dark decay Fatigue |
|---|---|---|---|---|---|---|
| | | Electrical characteristics before (initial) and following a 20 min. exposure to room light and its recovery (Rec) following a 2 h rest. (exposure-of 76 ms to-develop) | | | | |
| Transport 9 (Control) | 17 | −856/−851/−850 | −214/−150/−217 | −138/−85/−94 | −124/−79/−85 | 64/118/108 |
| Transport 10 (Acetosol Yellow 5GLS) | 17 | −851/−854/−847 | −255/−206/−243 | −185/−131/−141 | −165/−118/−127 | 55/97/90 |
| Transport 11 (TPCPDEO) | 21 | −849/−851/−850 | −254/−226/−243 | −197/−167/−172 | −177/−153/−157 | 55/59/54 |
| Transport 12 (AY/TPCPDEO 1/1) | 21 | −847/−847/−839 | −269/−231/−266 | −215/−175/−197 | −199/−162/−183 | 47/62/60 |

The control drum exhibits about a 50V positive fatigue on exposure to room light. The increased sensitivity may also be due to the increase in dark decay, when the drums fatigue on exposure to room light. The fatigue is however mitigated on adding acetosol yellow 5GLS or TPCPDEO, or a mixture of the two. The presence of TPCPDEO appears to be a significant contributor to the RLF resistance, and the smallest change in electrical characteristics and dark decay is observed when the additives are used together. The drum also exhibits relatively stable dark decay, and a tendency to fully recover following a 2 h rest.

9-fluorenone was also evaluated for its ability in controlling room light fatigue associated with benzidene, as either pure materials or as a blend with acetosol yellow 5GLS. Formulations and results are presented in Tables 9–12. All ratios are by weight.

TABLE 9

| Materials | Transport 13 (Control) | Transport 14 (Acetosol Yellow 5GLS) | Transport 15 (AY:Fluorenone 3/1) | Transport 16 (AY:Fluorenone 1/1 |
|---|---|---|---|---|
| | Formulations involving acetosol yellow 5GLS and fluorenone blends | | | |
| MAKROLON-5208 | 45.5 g | 45.5 g | 45.5 g | 45.5 g |
| TPD | 24.5 g | 24.5 g | 24.5 g | 24.5 g |
| Surfactant (DC-200) | 6 drops | 6 drops | 6 drops | 6 drops |
| THF | 210 g | 210 g | 210 g | 210 g |
| 1,4-dioxane | 70 g | 70 g | 70 g | 70 g |
| TOSPEARL-120 | 0.70 g | 0.70 g | 0.70 g | 0.70 g |
| Acetosol Yellow 5GLS | 0 g | 1.40 g | 1.05 g | 0.70 g |
| 9-Fluorenone | 0 g | 0 g | 0.35 g | 0.70 g |

TABLE 10

Electrostatic characteristics for acetosol yellow 5GLS/fluorenone blends with TPD transport material (room light exposure: 1 h). charge generation layer: 45% TiOpc (type IV/type I); BX55Z polyvinylbutyral/epoxy resin (1/1); expose-to-develop time: 135 ms

| Transport | Ct. wt. (mg/in2) | 0.0 μJ/cm² V(In/RLE) | 0.2 μJ/cm² V(In/RLE) | 0.34 μJ/cm² V(In/RLE) | 1 μJ/cm² V(In/RLE) | Dark Decay (In/RLE) |
|---|---|---|---|---|---|---|
| Transport 13 (Control) | 18.1/18.3 | −734/−732 | −185/−82 | −105/−44 | −77/−42 | 23/72 |
| Transport 14 (Acetosol Yellow 5GLS) | 18.6/18.8 | −744/−761 | −188/−93 | −105/−55 | −105/−52 | 30/108 |
| Transport 15 (AY:Fluorene 3/1) | 19.5/19.6 | −741/−762 | −198/−153 | −127/−97 | −103/−90 | 28/59 |
| Transport 16 (AY:Fluorenone 1/1) | 18.1/17.8 | −745/−730 | −199/−158 | −114/−98 | −89/−91 | 30/51 |

| Transport | Ct. weight (mg/in2) | 0.2 μJ/cm² V Fatigue | 0.34 μJ/cm² V Fatigue | 1 μJ/cm² V Fatigue | Dark Decay Fatigue |
|---|---|---|---|---|---|
| Transport 13 (Control) | 18.1/18.3 | 103 | 61 | 35 | 49 |
| Transport 14 (Acetosol Yellow) | 18.6/18.8 | 95 | 50 | 53 | 78 |
| Transport 15 (AY:Fluorenone 3/1) | 19.5/19.6 | 45 | 30 | 13 | 31 |
| Transport 16 (AY:Fluorenone 1/1) | 18.1/17.8 | 41 | 16 | −2 | 21 |

Both the control drum (no room light fatigue mitigant additives) and 2% acetosol yellow 5GLS exhibit positive fatigue on exposure to room light (1 hour). However, as the acetosol yellow 5GLS concentration is lowered and on addition of 9-flourenone, the tendency to exhibit positive light fatigue is reduced. This is evident from the behavior of Transports 15 and 16. Transports 15 and 16 correspond to a 3/1 and 1/1 mixture of acetosol yellow 5GLS and 9-fluorenone, respectively. Increase in the fluorenone concentration in the blend mixture, reduces the room light fatigue, i.e. fatigue related to the discharge voltage and dark decay.

TTA Transport

Tri(p-tolyl)amine is known to exhibit fatigue, when exposed to white fluorescent light. The room light fatigue agents namely, a 1:1 mixture by weight of TPCPDEO and acetosol yellow 5GLS was used in the TTA based transport formulation, at a 1.5% by weight concentration. Effect of curing the drums with UV radiation was also studied. The formulations and electrostatics for a drum exposed to white fluorescent light are given below:

TABLE 11

RLF additives in a TTA transport. APEC 9201 is a commercially available resin of mixed polycarbonates.

| Materials | Transport 17 (Control) | Transport 18 (SY:TPCPDEO 1/1) |
|---|---|---|
| APEC 9201 | 13.5 g | 13.5 |
| TTA | 9 g | 9 g |
| Surfactant (DC-200) | 3 drops | 3 drops |
| THF | 67.5 g | 67.5 g |
| 1,4-dioxane | 22.5 g | 22.5 g |
| Acetosol Yellow | 0 g | 0.19 g |
| TPCPDEO | 0 g | 0.19 g |

On exposing the TTA drum to white fluorescent light, the discharge voltage is increased significantly (−150V). Also, on subjecting the drum to a UV radiation, the photoconducting properties are dramatically affected, and the net result is an insulator. However, the addition of the TPCPDEO/acetosol yellow 5GLS mixture in the transport matrix eliminates any fatigue from the white fluorescent light. The increase in the discharge voltage is also reduced significantly, when the additive containing drums are UV cured.

Hence it is apparent from the above, that the use of the tetraphenylcyclopentadienone or fluorenone with acetosol yellow 5GLS as additive blends in an arylamine or hydrazone transport system helps mitigate the effect of room light (white fluorescent light) on the performance of the photoconductor drum. These additives may also be used in the charge generation layer to lower the fatigue induced by exposing drums to room light.

What is claimed is:

1. A photoconductor comprising a charge generation layer and a charge transport layer, at least one of said layers comprising a material selected from the group consisting of tetraphenylcyclopentadienone and 9-fluorenone and also comprising 1 percent to 5 percent by weight of C.I. Solvent Yellow 138 based on the total weight of said at least one layer.

2. The photoconductor as in claim 1 in which said at least one layer comprises tetraphenyicyclopentadienone.

3. The photoconductor as in claim 1 in which said at least one layer comprises 9-fluorenone.

4. A photoconductor comprising a charge generation layer and a charge transport layer, said charge transport layer comprising a material selected from the group consisting of tetraphenylcyclopentadienone and 9-fluorenone and also comprising 1 percent to 5 percent by weight of C.I. Solvent Yellow 138 based on the weight of said charge transport layer.

TABLE 12

Effect of room light exposure on initial electrostatics for TTA transport containing photoconductors
(CG: 45% TiOpc (type IV); BX55Z, expose-to develop time: 76 ms)

| Additive (1.5%) | Ct. wt. (mg/in2) | UV Cure | 0.0 μJ/cm$^2$ V(In/RLE) | 0.2 μJ/cm$^2$ V(in/RLE) | 0.4 μJ/cm$^2$ V(In/RLE) | 0.8 μJ/cm$^2$ V(In/RLE) | Dark decay (In/RLE) |
|---|---|---|---|---|---|---|---|
| Transport 17 No Additive | 18.5 | No | −852/−852 | −234/−353 | −184/−336 | −170/−355 | 62/75 |
| Transport 17 No Additive | 19.2 | Yes | −850/−853 | −848/−856 | −854/−860 | −862/−872 | 15/15 |
| Transport 18 SY:TPCPDEO (1/1) | 19.5 | No | −844/−852 | −276/−264 | −235/−232 | −226/−224 | 49/56 |
| Transport 18 SY:TPCPDEO (1/1) | 19.2 | Yes | −852/−849 | −345/−307 | −315/−279 | −312/−279 | 50/66 |

| Additive (1.5%) | Ct. wt. (mg/in2) | UV Cure | 0.2 μJ/cm$^2$ V Fatigue | 0.4 μJ/cm$^2$ V Fatigue | 0.8 μJ/cm$^2$ V Fatigue | Dark decay Fatigue |
|---|---|---|---|---|---|---|
| Transport 17 No Additive | 18.5 | No | −119 | −152 | −185 | 13 |
| Transport 17 No Additive | 19.2 | Yes | — | — | — | — |
| Transport 18 SY:TPCPDEO (1/1) | 19.5 | No | 8 | 3 | 2 | 7 |
| Transport 18 SY:TPCPDEO (1/1) | 19.2 | Yes | 38 | 31 | 33 | 16 |

5. The photoconductor as in claim 4 in which said charge transport layer comprises tetraphenylcyclopentadienone.

6. The photoconductor as in claim 4 in which said charge transport layer comprises 9-fluorenone.

7. The photoconductor as in claim 5 in which said charge transport layer comprises a material selected from the group consisting of hydrazones and arylamines as charge transport materials.

8. The photoconductor as in claim 6 in which said charge transport layer comprises a material selected from the group consisting of hydrazones and arylamines as charge transport materials.

9. The photoconductor as in claim 7 in which the ratio by weight of said C.I. Solvent Yellow 138 to said tetraphenylcyclopentadienone is in the range of 1:1 to 1:3.

10. The photoconductor as in claim 8 in which the ratio by weight of said C.I. Solvent Yellow 138 to said 9-fluorenone is in the range of 1:1 to 1:3.

11. The photoconductor as in claim 4 in which said C.I. Solvent Yellow 138 is in amount of 2 percent to 4 percent by weight of the weight of said charge transport layer.

12. The photoconductor as in claim 5 in which said C.I. Solvent Yellow 138 is in amount of 2 percent to 4 percent by weight of the weight of said charge transport layer.

13. The photoconductor as in claim 6 in which said C.I. Solvent Yellow 138 is in amount of 2 percent to 4 percent by weight of the weight of said charge transport layer.

14. The photoconductor as in claim 7 in which said C.I. Solvent Yellow 138 is in amount of 2 percent to 4 percent by weight of the weight of said charge transport layer.

15. The photoconductor as in claim 8 in which said C.I. Solvent Yellow 138 is in amount of 2 percent to 4 percent by weight of the weight of said charge transport layer.

16. The photoconductor as in claim 9 in which said C.I. Solvent Yellow 138 is in amount of 2 percent to 4 percent by weight of the weight of said charge transport layer.

17. The photoconductor as in claim 10 in which said C.I. Solvent Yellow 138 is in amount of 2 percent to 4 percent by weight of the weight of said charge transport layer.

* * * * *